US009905176B2

(12) United States Patent
Kim

(10) Patent No.: US 9,905,176 B2
(45) Date of Patent: Feb. 27, 2018

(54) DISPLAY DEVICE

(71) Applicant: Samsung Display Co., Ltd., Yongin-si, Gyeonggi-Do (KR)

(72) Inventor: Duk-Sung Kim, Asan-si (KR)

(73) Assignee: Samsung Display Co., Ltd. (KR)

( * ) Notice: Subject to any disclaimer, the term of this patent is extended or adjusted under 35 U.S.C. 154(b) by 43 days.

(21) Appl. No.: 14/844,668

(22) Filed: Sep. 3, 2015

(65) Prior Publication Data

US 2016/0225303 A1 Aug. 4, 2016

(30) Foreign Application Priority Data

Jan. 29, 2015 (KR) ..... 10-2015-0014519

(51) Int. Cl.
*G09G 3/20* (2006.01)
*G09G 3/36* (2006.01)

(52) U.S. Cl.
CPC ..... *G09G 3/3648* (2013.01); *G09G 3/3614* (2013.01); *G09G 2300/0452* (2013.01); *G09G 2320/0204* (2013.01); *G09G 2330/021* (2013.01)

(58) Field of Classification Search
CPC ..... G09G 3/3614; G09G 3/3648; G09G 2330/021; G09G 2320/0204
See application file for complete search history.

(56) References Cited

U.S. PATENT DOCUMENTS

2011/0050553 A1* 3/2011 Takada ..... G09G 3/3688 345/96
2011/0128272 A1* 6/2011 Chen ..... G09G 3/3614 345/211
2011/0215993 A1* 9/2011 Cho ..... G09G 3/36 345/87
2013/0106278 A1* 5/2013 Noguchi ..... G09G 3/3233 313/504
2013/0222747 A1* 8/2013 Hisada ..... G02F 1/134336 349/106
2015/0097877 A1* 4/2015 Lin ..... G09G 3/344 345/691
2015/0310815 A1* 10/2015 Deng ..... G09G 3/3614 345/209

FOREIGN PATENT DOCUMENTS

JP 2013101164 A 5/2013
KR 1020060077952 7/2006
KR 1011139970000 2/2012
KR 1012073180000 11/2012

* cited by examiner

*Primary Examiner* — Abbas Abdulselam
(74) *Attorney, Agent, or Firm* — Innovation Counsel LLP

(57) ABSTRACT

A display device includes: a display panel including a plurality of pixels and a plurality of dots having a pixel set including n pixels of the plurality of pixels as a unit; a signal controller configured to receive input image signals for the pixels and process the input image signals to generate output image signals; and a data driver configured to convert the output image signals into data voltages and apply the data voltages to the display panel, wherein the data driver is configured to apply data voltages having different polarities to a first dot and a second dot of the plurality of dots, the second dot being positioned in a row that is the same as a row in which the first dot is positioned to neighbor the first dot.

9 Claims, 8 Drawing Sheets

DISPLAY DEVICE

CROSS-REFERENCE TO RELATED APPLICATION

This application claims priority to and the benefit of Korean Patent Application No. 10-2015-0014519 filed in the Korean Intellectual Property Office on Jan. 29, 2015, the entire contents of which are incorporated herein by reference.

BACKGROUND (a) Field

The present application relates to a display device. More particularly, the present application relates to a display device capable of being driven with low power.

(b) Description of the Related Art

A display device such as a liquid crystal display (LCD), an organic light emitting diode display, or the like, generally includes a display panel including a plurality of pixels and a plurality of signal lines and a driving unit driving the display panel. The respective pixels include switching elements connected to the signal lines, pixel electrodes connected to the switching elements, and counter electrodes. The driving unit includes a gate driver supplying gate signals to the display panel, a data driver supplying data signals to the display panel, a signal controller controlling the data driver and the gate driver, and the like.

The pixel electrodes are connected to the switching elements such as thin film transistors (TFTs), or the like, to receive data voltages. The counter electrodes are formed over an entire surface of the display panel, and may receive a common voltage Vcom applied thereto. The pixel electrodes and the counter electrodes may be positioned on the same substrate or be positioned on different substrates.

For example, the liquid crystal display includes two display panels including the pixel electrodes and the counter electrodes and a liquid crystal layer disposed between the two display panels and having dielectric anisotropy. The pixel electrodes are arrange in a matrix form and are connected to the switching elements such as thin film transistors (TFTs), or the like, to sequentially receive the data voltage row by row. The counter electrodes are formed over the entire surface of the display panel, and receive the common voltage Vcom applied thereto. Voltages are applied to the pixel electrodes and the counter electrodes to generate an electric field in the liquid crystal layer, and the strength of the electric field is adjusted to adjust transmittance of light passing through the liquid crystal layer, thereby making it possible to obtain a desired image.

The display device receives an input image signal from an external graphic controller, wherein the input image signal includes luminance information of each pixel, and each luminance has a predetermined number of grays. Each pixel receives data voltages corresponding to desired luminance information. The data voltages applied to the pixels appear as pixel voltages depending on differences between the data voltages and a common voltage applied to a common electrode, and each pixel displays luminance representing a gray of an image signal depending on pixel voltages. Here, in the case of the liquid crystal display, in order to prevent a degradation phenomenon generated when the electric field in one direction is applied to the liquid crystal layer for a long time, polarities of data voltages for a reference voltage may be inverted for each frame, each row, each column, and each pixel. In addition, in order to decrease power consumption of the display device, data voltages having different polarities may be applied to each column.

The above information disclosed in this Background section is only for enhancement of understanding of the background and therefore it may contain information that does not form the prior art that is already known in this country to a person of ordinary skill in the art.

SUMMARY

Embodiments have been made in an effort to provide a display device having features of decreasing power consumption of the display device and removing a luminance deviation in a vertical column direction by applying data voltages having different polarities to each pixel.

An exemplary embodiment provides a display device including: a display panel including a plurality of pixels and a plurality of dots having a pixel set including n pixels of the plurality of pixels as a unit; a signal controller configured to receive input image signals for the pixels and process the input image signals to generate output image signals; and a data driver configured to convert the output image signals into data voltages and apply the data voltages to the display panel, wherein the data driver is configured to apply data voltages having different polarities to a first dot and a second dot of the plurality of dots, the second dot being positioned in a row that is the same as a row in which the first dot is positioned to neighbor the first dot.

The data driver may be configured to apply the data voltages to the display panel through a plurality of data lines, the plurality of data lines being bent in a '⊟' shape.

Directions in which the plurality of pixels are positioned based on the data lines may be determined depending on directions in which the data lines are bent.

The plurality of dots may include four pixels that are arranged in a 2×2 matrix form in the dot.

The four pixels may be a red pixel, a green pixel, a blue pixel, and a white pixel.

The first dot and the second dot may have the same pixel layout.

The data driver may be configured to apply data voltages having polarities inverted in a one-dot unit to a plurality of dots positioned in the same row.

The data driver may be configured to apply data voltages having polarities inverted in a two-dot unit to a plurality of dots positioned in the same column.

The data driver may be configured to apply data voltages having polarities inverted in a four-dot unit to a plurality of dots positioned in the same column.

The data driver may be configured to apply data voltages having polarities inverted in an eight-dot unit to a plurality of dots positioned in the same column.

According to an exemplary embodiment, the data voltage of which the polarity is changed in the one-dot unit is applied to the pixels positioned in the respective rows, and the data voltage of which the polarity is changed in the two-dot unit are applied to the pixels positioned in the respective columns, thereby making it possible to implement low power driving of the display device and remove luminance deviation between the pixels disposed in the vertical column.

DETAILED DESCRIPTION OF THE EMBODIMENTS

The inventive concept will be described more fully hereinafter with reference to the accompanying drawings, in which exemplary embodiments are shown. As those skilled in the art would realize, the described embodiments may be modified in various different ways, all without departing from the spirit or scope of the inventive concept.

Hereinafter, a display device and a driving method thereof according to an exemplary embodiment will be described in detail with reference to the accompanying drawings.

First, a display device according to an exemplary embodiment will be described with reference to FIG. 1.

Figure 1:
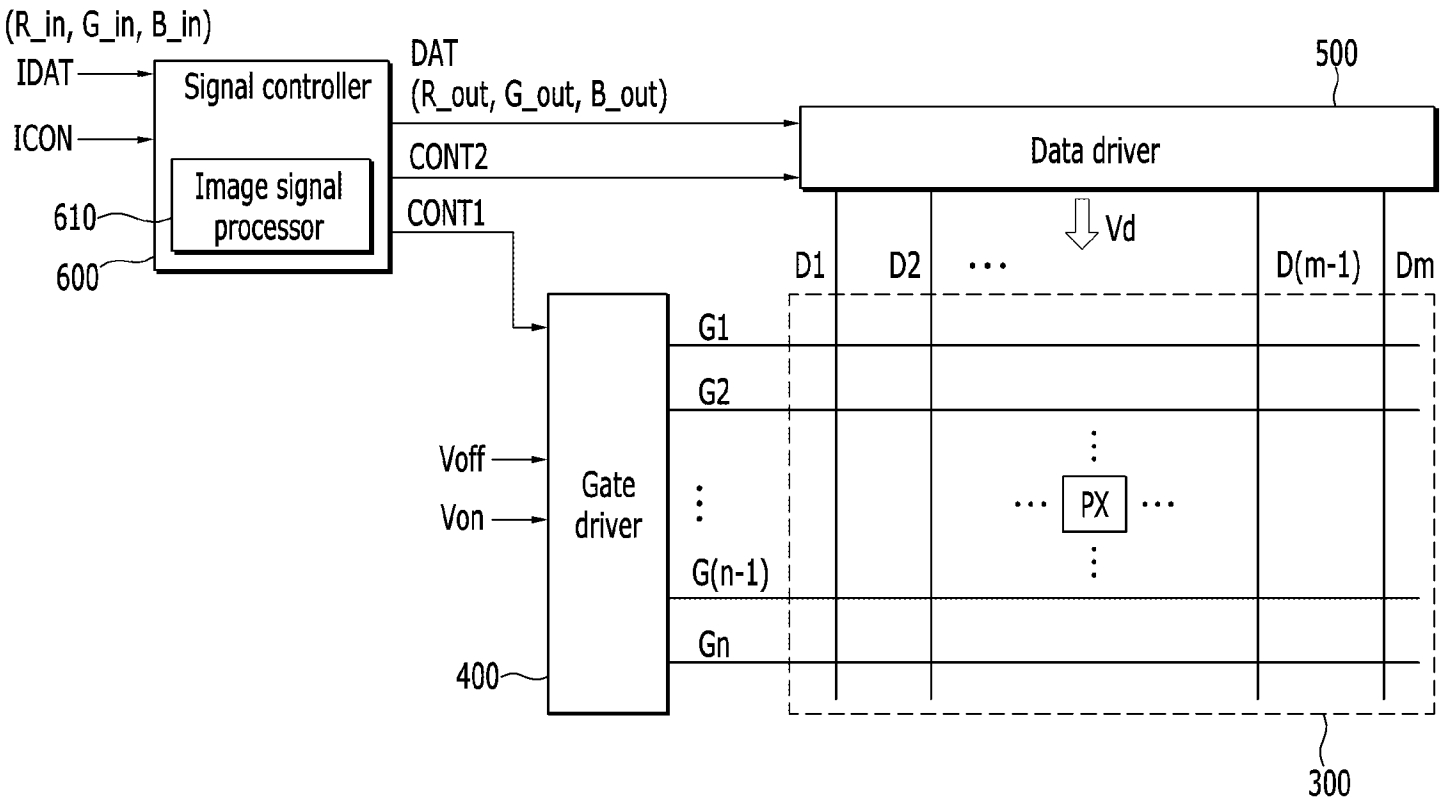
FIG. 1 is a block diagram of a display device according to an exemplary embodiment.

FIG. 1 is a block diagram of a display device according to an exemplary embodiment.

Referring to FIG. 1, the display device according to an exemplary embodiment includes a display panel 300, a gate driver 400 and a data driver 500 connected to the display panel 300, and a signal controller 600.

The display panel 300 includes a plurality of signal lines and a plurality of pixels connected to the plurality of signal lines and arranged in an approximately matrix form, when viewed in an equivalent circuit thereof. In the case in which the display device according to an exemplary embodiment is a liquid crystal display, the display panel 300 may include lower and upper panels (not shown) opposing each other and a liquid crystal layer (not shown) disposed between the lower and upper panels, when viewed in a cross-sectional structure thereof.

The signal lines includes a plurality of gate lines G1 to Gn transferring gate signals (also referred to as "scanning signals") and a plurality of data lines D1 to Dm transferring data voltages.

The pixel PX may include at least one switching element (not shown) connected to at least one data line D1, D2, . . . , Dm and at least one gate line G1, G2, . . . , Gn, and at least one pixel electrode (not shown) connected to the at least one switching element. The switching element may include at least one thin film transistor, and may be controlled by the gate signal transferred by the gate lines G1, G2, . . . , Gn to transfer the data voltage Vd transferred by the data line D1, D2, . . . , Dm to the pixel electrode of each pixel PX.

Each pixel PX may display one of primary colors (spatial division) in order to implement a color display or alternately display the primary colors over time (temporal division) allow a desired color to be recognized by spatial and temporal sums of these primary colors. An example of the primary colors may include three primary colors or four primary colors such as a red, R, a green, G, and a blue, B or a yellow Y, a cyan C, and a magenta M. The plurality of pixels PX that display different primary colors and are adjacent or are not adjacent to each other may form one set (referred to as a dot), and one dot may display a white image. An exemplary embodiment will be described based on a dot having a set including a red pixel, a green pixel, a blue pixel, and a white pixel as one unit.

The data driver 500 is connected to the data lines D1 to Dm, selects gray voltages based on output image signals DAT input from the signal controller 600, and applies the gray voltages as the data voltages Vd to the data lines D1 to Dm. The data driver 500 may receive gray voltages generated by a separate gray voltage generator (not shown), and receive only a limited number of reference gray voltages and divide the limited number of reference gray voltages to generate gray voltages for all grays.

The gate driver 400 is connected to the gate lines G1 to Gn to apply the gate signals each configured of a combination of a gate-on voltage Von and a gate-off voltage Voff to the gate lines G1 to Gn.

The signal controller 600 receives input image signals IDAT and input control signals ICON from a graphic controller (not shown), or the like, and controls operations of the gate driver 400, the data driver 500, and the like.

The graphic controller may process image data input from the outside to generate the input image signals IDAT and then transmit the input image signals IDAT to the signal controller 600. For example, the graphic controller may or may not perform a frame rate control for inserting an intermediate frame between neighboring frames, or the like, in order to decrease a motion blur.

The input image signals (IDAT) include luminance information of each pixel, and luminance has a predetermined number of grays, for example, $1024=2^{10}$, $256=2^{8}$ or $64=2^{6}$ grays. The input image signals IDAT may be present for each primary color displayed by the pixels PX. For example, in the case in which the pixels PX display any one of the primary colors of the red, the green, and the blue, the input image signals IDAT may include a red input image signal R_in, a green input image signal G_in, and a blue input image signal B_in.

An example of the input control signals ICON includes a vertical synchronization signal, a horizontal synchronization signal, a main clock signal, a data enable signal, and the like.

The signal controller 600 processes the input image signals IDAT based on the input image signals IDAT and the input control signals ICON to convert the input image signals IDAT into the output image signals DAT and generate a gate control signal CONT1, a data control signal CONT2, and the like. In the case in which the pixels PX display any one of the primary colors of the red, the green, and the blue, the output image signals DATs may include a red output image signal R_out, a green output image signal G_out, and a blue output image signal B_out. The data control signal CONT2 may further include an inversion signal inverting polarities (referred to as polarities of the data voltages) of the data voltages Vd for the common voltage Vcom.

The signal controller 600 includes an image signal processor 610 processing the received input image signals IDAT so as to be appropriate for a condition of the display panel 300.

Next, a driving method of the display panel will be described.

The signal controller 600 receives the input image signals IDAT and the input control signals ICON controlling displays of the input image signals IDAT from the outside. The signal controller 600 processes the input image signals IDAT to convert the input image signals IDAT to the output image signals DAT and generate the gate control signal CONT1, the data control signal CONT2, and the like. The signal controller 600 transmits the gate control signal CONT1 to the gate driver 400 and transmits the data control signal CONT2 and the output image signals DAT to the data driver 500.

The data driver 500 receives the output image signals DAT for one row of pixels PX depending on the data control signal CONT2 from the signal controller 600 and selects gray voltages corresponding to the respective output image signals DAT to convert the output image signals DAT into analog data voltages Vd and then apply the analog data voltages Vd to corresponding data lines D1 to Dm.

The gate driver 400 applies the gate-on voltages to the gate lines G1 to Gn depending on the gate control signal CONT1 from the signal controller 600 to turn on the switching elements connected to the gate lines G1 to Gn. In this case, the data voltages Vd applied to the data lines D1 to Dm are applied to corresponding pixels PX through the turned-on switching elements to appear as pixel voltages, which are charging voltages of the pixels PX. When the data voltages Vd are applied to the pixels PX, the pixels PX may display luminance corresponding to the data voltages Vd through various optical converting elements such as a liquid crystal layer. For example, in the case of the liquid crystal display, an inclination level of liquid crystal molecules of a liquid crystal layer is controlled to adjust polarization of light, thereby making it possible to display luminance corresponding to a gray of the input image signal IDAT.

This process is repeated in a unit of 1 horizontal period (which is referred to "1H" and is the same as one period of a horizontal synchronization signal Hsync and a data enable signal DE) to sequentially apply the gate-on voltages Von to all the gate lines G1 to Gn and apply the data voltages Vd to all the pixels PX, thereby displaying an image of one frame.

A state of the inversion signal included in the data control signal CONT2 may be controlled so that when one frame ends, the next frame starts, and polarities of the data voltages Vd applied to each pixel PX are inverse to those of the data voltages of the previous frames (referred to as frame inversion). At the time of the frame inversion, the polarities of the data voltages Vd applied to all the pixels may be inverted per one or more frame. A polarity of the data voltage Vd flowing through one data line D1 to Dm may be periodically changed or polarities of the data voltages Vd applied to one pixel row of data lines D1 to Dm may be different from each other, depending on characteristics of the inversion signal even in one frame.

Figure 2:
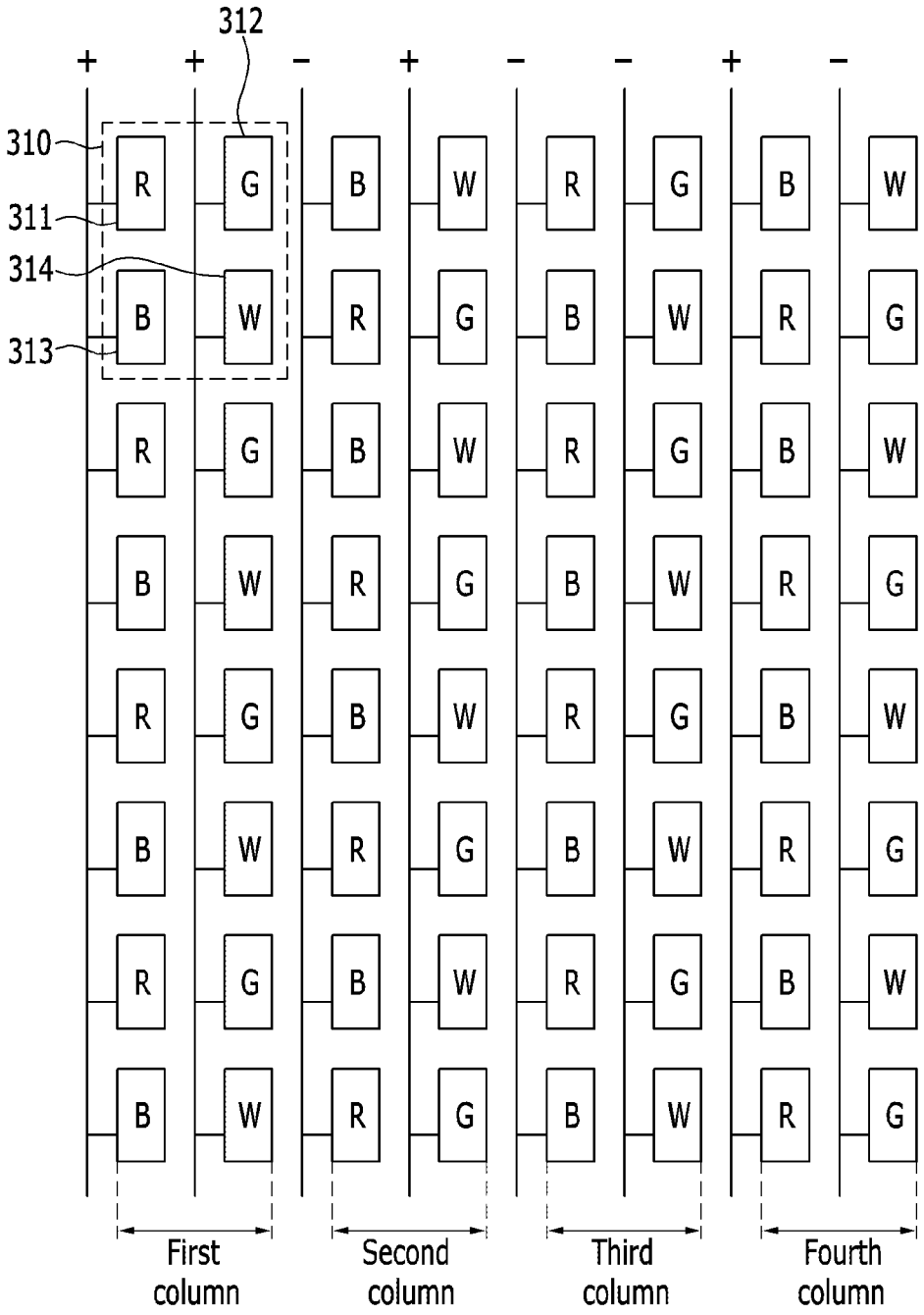
FIG. 2 is a view showing a pixel layout of the display device according to an exemplary embodiment.

FIG. 2 is a view showing a pixel layout of the display device according to an exemplary embodiment.

Referring to FIG. 2, the display panel 300 according to an exemplary embodiment includes a plurality of gate lines extended in a row direction and a plurality of data lines extended in a column direction, and a plurality of pixels PX. The respective pixels PX may include pixel electrodes (not shown) connected to the gate lines and the data lines through switching elements (not shown). Although the case in which the respective pixels PX display primary colors of a red R, a green G, and a blue B has been shown in the present exemplary embodiment, the embodiments are not limited thereto.

Referring to FIG. 2, a red pixel 311, a green pixel 312, a blue pixel 313, and a white pixel 314 form one dot 310. That is, pixels PX such as the red pixel, and the like, are arranged in a 2×2 matrix form in each dot.

Here, data voltages having different polarities may be applied to each column of each dot in each dot. Referring to FIG. 2, a data voltage having a positive (+) polarity is applied to dots included in a first column. In addition, a data voltage having a negative (−) polarity is applied to a left column of dots included in a second column, and a data voltage having a positive (+) polarity is applied to a right column thereof. A data voltage having a negative (−) polarity is applied to dots included in a third column. A data voltage having a positive (+) polarity is applied to a left column of dots included in a fourth column, and a data voltage having a negative (−) polarity is applied to a right column thereof. As described above, the data voltages having different polarities are applied to each column of each pixel PX, thereby making it possible to decrease power consumption depending on driving of the display device.

Figure 3:
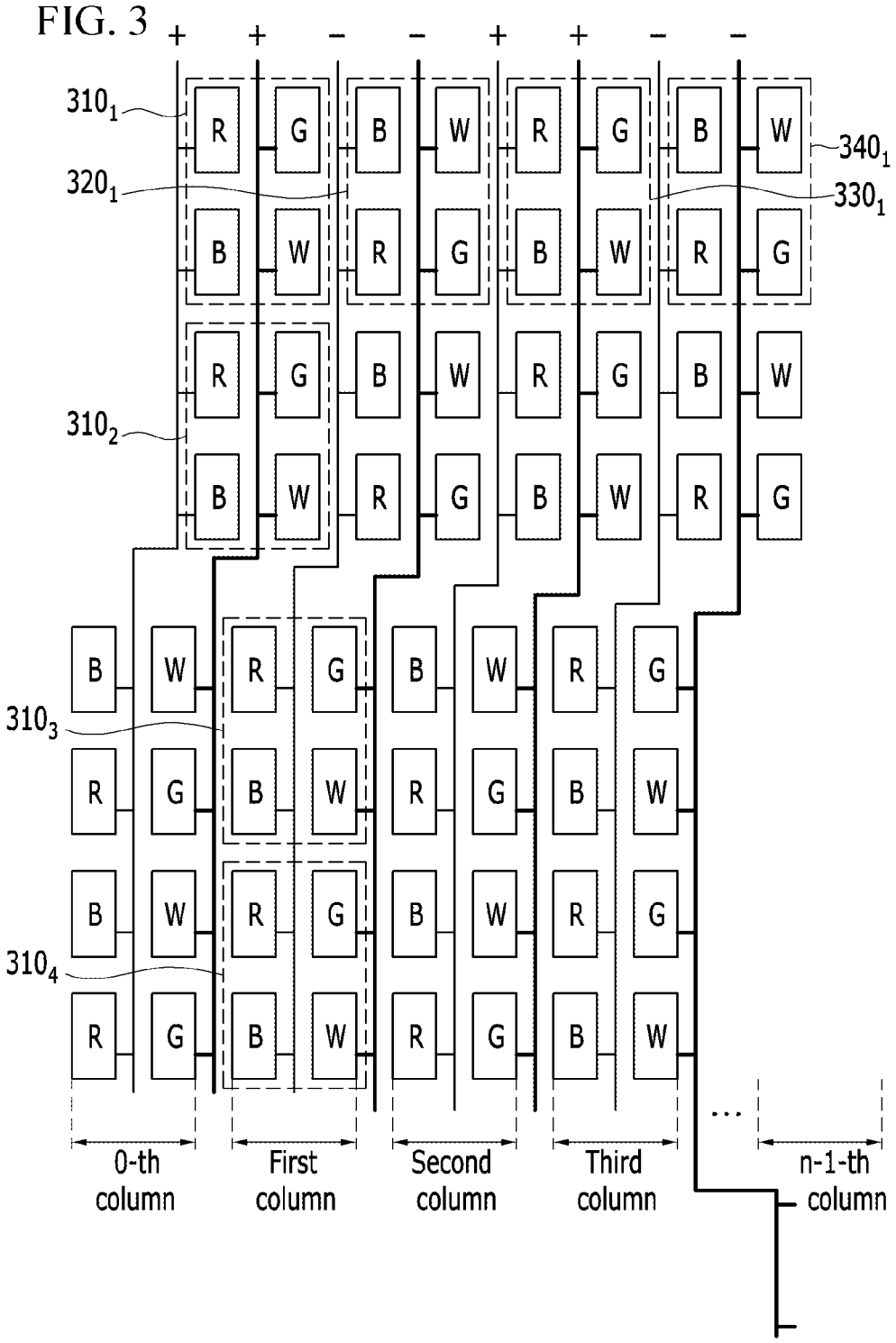
FIG. 3 is a view showing a pixel layout of a display device according to another exemplary embodiment.
Figure 4A:
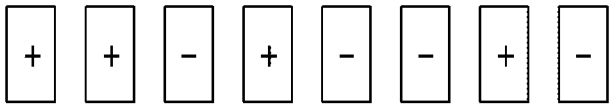
FIGS. 4A and 4B are views showing polarities of data voltages applied to the display device according to another exemplary embodiment.
Figure 4B:
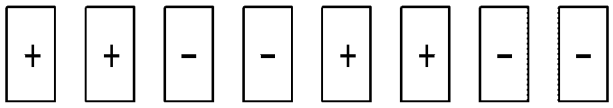

FIG. 3 is a view showing a pixel layout of a display device according to another exemplary embodiment, and FIGS. 4A and 4B are views showing polarities of data voltages applied to the display device according to another exemplary embodiment.

In another exemplary embodiment shown in FIG. 3, dots are disposed as in FIG. 2, but the respective data lines are bent in a '三' shape. Due to the data lines bent in the '三' shape, first and second rows of dots are arranged from a first column to an n-th column, and third and fourth rows of dots are arranged in from a 0-th column to an n−1-th column. That is, the respective columns of dots are disposed so as to be misaligned with each other by one column in a two-dot unit. In FIG. 3, the respective data lines are represented by thick solid lines or general solid lines, wherein the thick solid lines are to clearly represent pixels connected to the data lines represented thereby, and the data lines represented by the thick solid lines and the data lines represented by the general solid lines may perform the same function.

In another exemplary embodiment, the respective data lines may transfer data voltages having different polarities in a two-dot unit. That is, the data lines may transfer data voltages to dots positioned at the left or the right of the data lines in the two-dot unit in the column direction. Since two data lines positioned at the leftmost in FIG. 3 transfer a data voltage having a positive polarity, the data voltage having the positive polarity is applied to a first column of first and second dots $\mathbf{310}_1$ and $\mathbf{310}_2$. However, a data voltage having a negative polarity is applied to the first column of a third dot $\mathbf{310}_3$ and a fourth dot $\mathbf{310}_4$ by third and fourth data lines. That is, the data voltages having the different polarities may be applied in the two-dot unit to the respective dot columns of the display panel by the data lines bent in the '三' shape. Therefore, the display device according to an exemplary embodiment applies the data voltages having the different polarities per two dots in the column direction, thereby making it possible to remove a luminance deviation between pixels disposed in vertical columns.

Referring to FIGS. 4A and 4B, the data voltages are applied to the data lines of FIG. 3 so that polarities are repeated in a sequence of "+, +, −, −, +, +, −, and −" (FIG. 4B) although the data voltages are applied to the data lines so that polarities are repeated in a sequence of "+, +, −, −, +, −, −, +, and −" in FIG. 2 (FIG. 4A). That is, the polarities of the data voltages applied to the respective dots may be changed in a one-dot unit in the row direction (horizontal direction) and be changed in a two-dot unit in the column direction (vertical direction). In the display device according to an exemplary embodiment, the data voltages having different polarities are applied to dots adjacent to each other, thereby making it possible to prevent generation of a side effect due to repetition of the polarities.

Figure 5:
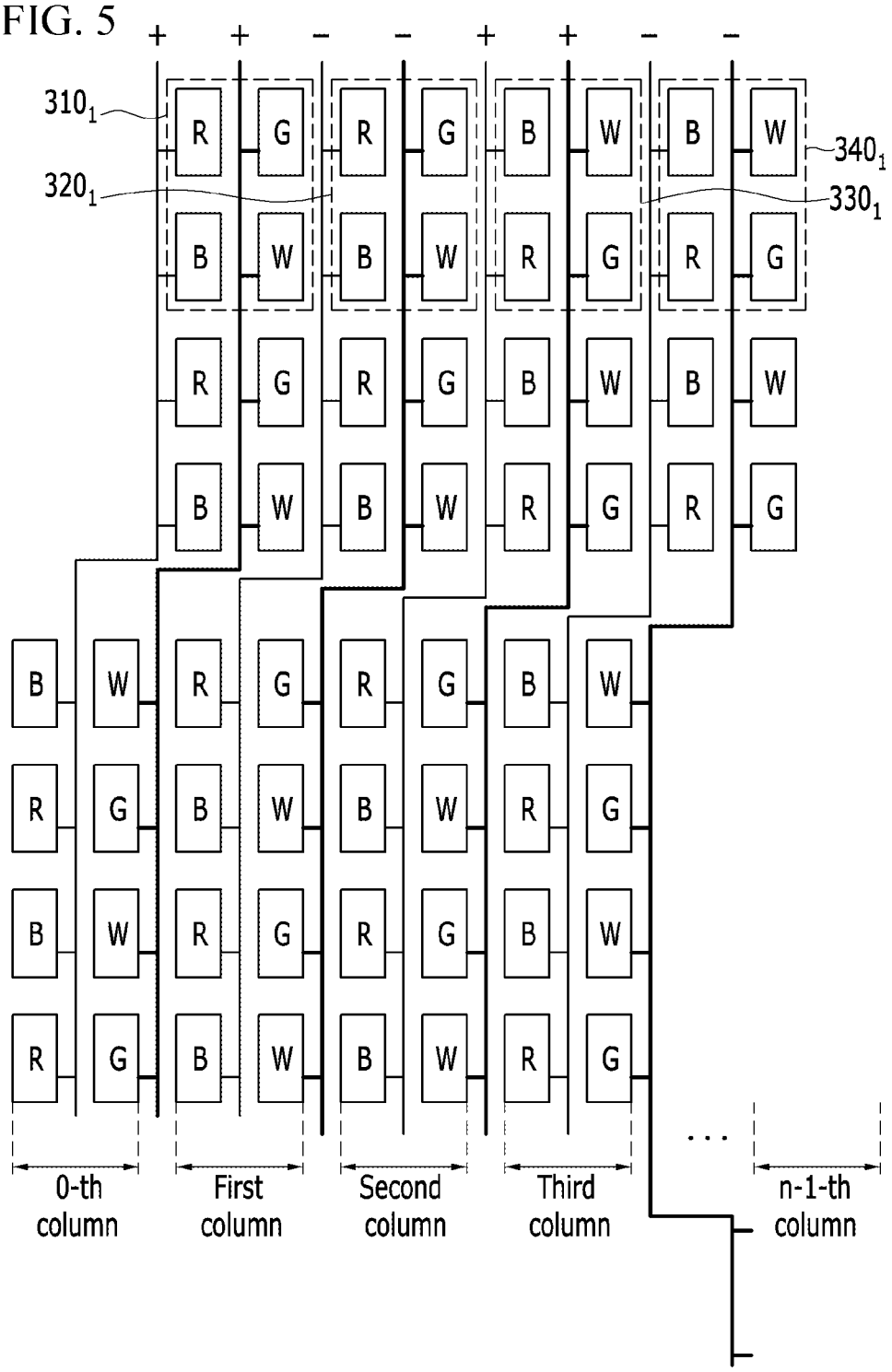
FIG. 5 is a view showing a pixel layout of the display device according to another exemplary embodiment.
Figure 6A:
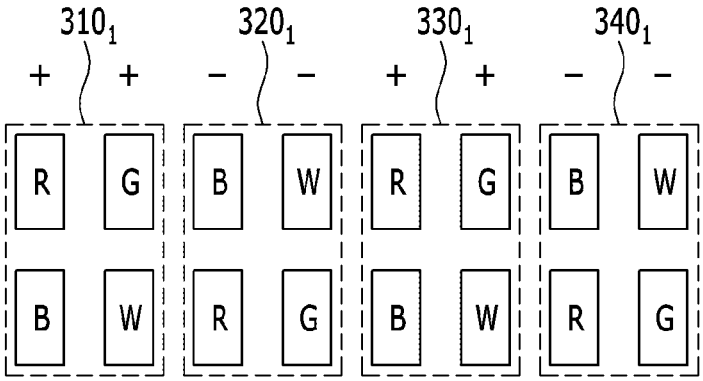
FIGS. 6A and 6B are views showing some of pixels included in the display device according to another exemplary embodiment.
Figure 6B:
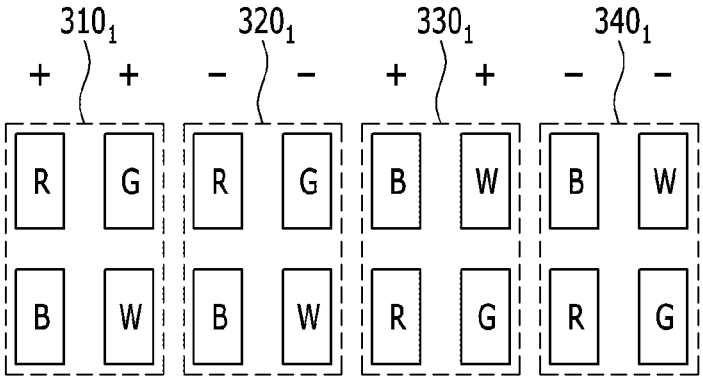

FIG. 5 is a view showing a pixel layout of the display device according to another exemplary embodiment, FIGS. 6A and 6B are views showing some of pixels included in the display device according to another exemplary embodiment.

When comparing a first dot $\mathbf{310}_1$ and a second dot $\mathbf{320}_1$ with each other in FIG. 5, pixel layouts of the first dot $\mathbf{310}_1$ and the second dot $\mathbf{320}_1$ are the same as each other, unlike FIG. 3. That is, in FIG. 5, pixels PX positioned in the same row in dots neighboring to each other are disposed so as to be the same as each other, such that polarities of data voltages applied to the dots neighboring to each other may be accurately inverted.

FIGS. 6A and 6B are views showing dots positioned in first rows of FIGS. 3 (FIG. 6A) and 5 (FIG. 6B). Referring to FIG. 6A, in the first row of FIG. 3, pixels of the first dot $\mathbf{310}_1$ and the second dot $\mathbf{320}_1$ neighboring to each other are disposed at upper and lower portions so as to be opposite to each other, and pixels of a third dot $\mathbf{330}_1$ and a fourth dot $\mathbf{340}_1$ neighboring to each other are disposed at upper and lower portions so as to be opposite to each other. However, referring to FIG. 6B, in the first row of FIG. 5, pixel layouts of the first dot $\mathbf{310}_1$ and the second dot $\mathbf{320}_1$ neighboring to each other are the same as each other, and pixel layouts of the third dot $\mathbf{330}_1$ and the fourth dot $\mathbf{340}_1$ neighboring to each other are the same as each other. Therefore, according to the pixel layout of the display panel of FIG. 5, polarity inversion driving for each dot may be implemented FIGS. 7A to 8E are views showing data lines according to another exemplary embodiment.

Figures 7A, 7B, 7C:
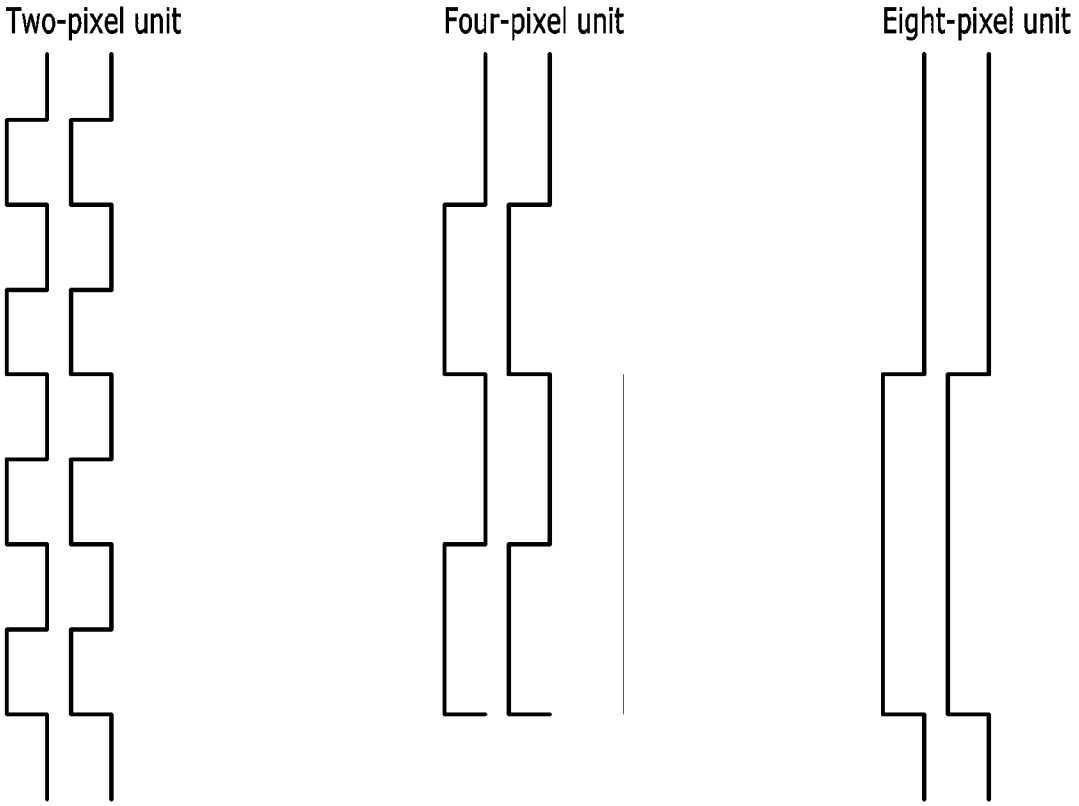
FIGS. 7A, 7B, 7C, 8A, 8B, 8C, 8D, and 8E are views showing data lines according to another exemplary embodiment.
Figures 8A, 8B, 8C, 8D, 8E:
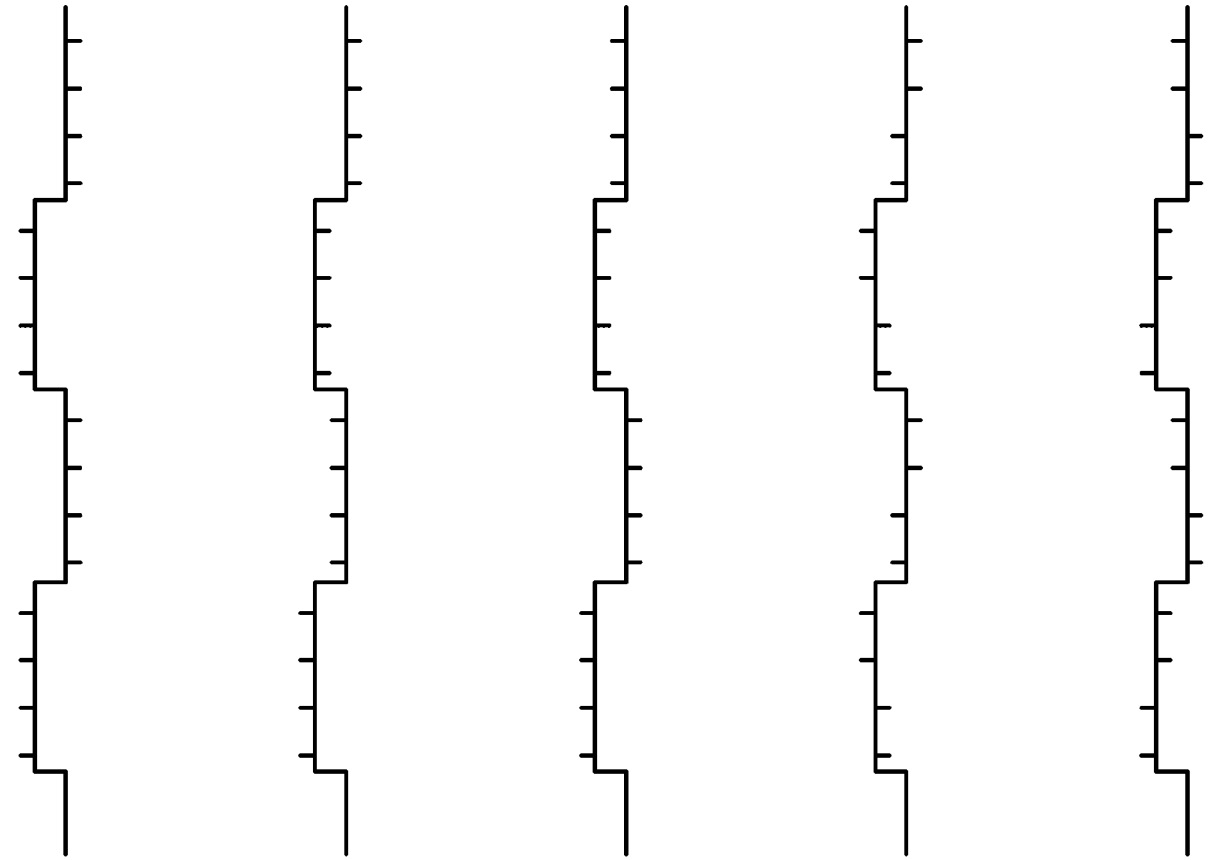

Referring to FIGS. 7A to 8E, data lines of FIGS. 7A and 8A are the same as the data lines shown in FIGS. 3 and 5. That is, the data lines may be alternately bent horizontally in a two-dot unit in the column direction, and pixels PX positioned in an outer side direction (↲→) of the data lines may be connected to the data lines. In an exemplary embodiment, a direction that is opposite to a direction in which the data line is bent to the Right based on a downward direction (column direction) is defined as an outer side direction of the data line in a corresponding portion, and a direction that is the same as the direction in which the data line is bent to the Right is defined as an inner side direction of the data line in a corresponding portion.

In FIG. 8A, four pixels PX disposed at the uppermost portion may be connected to the right of the data line, and the next four pixels PX may be connected to the left of the data line. Since data line portions to which the uppermost four pixels PX are connected are to the right, the data line portions to which the uppermost four pixels PX are connected are positioned in the outer side direction of the data line. Since data line portions to which the next four pixels PX are connected are bent to the right, the data line portions to which the next four pixels PX are connected are positioned in the outer side direction of the data line.

FIGS. 7B and 7C show data lines bent in a four-dot unit and an eight-dot unit, respectively. As shown in FIGS. 7B and 7C, even though the data lines are bent in the four-dot unit and the eight-dot unit, polarity inversion in the row direction may be maintained in a sequence of "+, +, −, −, +, +, −, and −".

Pixels are variously connected to the respective data lines shown in FIG. 8A-8E. For example, referring to FIG. 8B, pixels PX connected to the data line fifth to eighth from the top may be positioned at the right of the data line, that is, in the inner side direction of the data line, unlike FIG. 8A. Alternatively, referring to FIG. 8D, first two pixels PX are positioned in the outer side direction of the data line, and the next two pixels PX are positioned in the inner side direction of the data line. That is, according to another exemplary embodiment, as shown in FIG. 8D, connection positions of the data line may be changed in a two-pixel unit (one-dot unit).

According to an exemplary embodiment, the data voltage of which the polarity is changed in the one-dot unit are applied to the pixels positioned in the respective rows, and the data voltage of which the polarity is changed in the two-dot unit are applied to the pixels positioned in the respective columns, thereby making it possible to implement low power driving of the display device and remove luminance deviation between the respective pixels.

While the inventive concept has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

| <Description of symbols> | |
|---|---|
| 300: display panel | 400: gate driver |
| 500: data driver | 600: signal controller |
| 610: image signal processor | |

What is claimed is:

1. A display device comprising:

a display panel including a plurality of pixels and a plurality of dots having a pixel set including n pixels of the plurality of pixels as a unit;

a signal controller configured to receive input image signals for the pixels and process the input image signals to generate output image signals; and a data driver configured to convert the output image signals into data voltages and apply the data voltages to the display panel, wherein the data driver is configured to apply data voltages having different polarities to a first dot and a second dot of the plurality of dots, the second dot being positioned in a row that is the same as a row in which the first dot is positioned to neighbor the first dot, wherein:

each of the plurality of pixels is one of R, G, B, and W pixels, and the R, G, B, and W pixels form a dot unit, and the data driver is configured to apply the data voltages to the display panel through a plurality of data lines, the plurality of data lines being bent in a '⊏' shape such that respective columns of the dots are misaligned with each other by one column in a two-dot unit, each two-dot unit comprising two dots aligned in the column direction, the data lines being bent between each adjacent two-dot unit in the column direction.

2. The display device of claim 1, wherein:

directions in which the plurality of pixels are positioned based on the data lines are determined depending on directions in which the data lines are bent.

3. The display device of claim 1, wherein:

the plurality of dots include four pixels that are arranged in a 2×2 matrix form in the dot.

4. The display device of claim 3, wherein:

the four pixels are a red pixel, a green pixel, a blue pixel, and a white pixel.

5. The display device of claim 1, wherein:

the first dot and the second dot have the same pixel layout.

6. The display device of claim 1, wherein:

the data driver is configured to apply data voltages having polarities inverted in a one-dot unit to a plurality of dots positioned in the same row.

7. The display device of claim 6, wherein:

the data driver is configured to apply data voltages having polarities inverted in a two-dot unit to a plurality of dots positioned in the same column.

8. The display device of claim 6, wherein:

the data driver is configured to apply data voltages having polarities inverted in a four-dot unit to a plurality of dots positioned in the same column.

9. The display device of claim 6, wherein:

the data driver is configured to apply data voltages having polarities inverted in an eight-dot unit to a plurality of dots positioned in the same column.

* * * * *